US009861199B2

(12) United States Patent
Ferreira et al.

(10) Patent No.: US 9,861,199 B2
(45) Date of Patent: Jan. 9, 2018

(54) ADJUSTABLE SHELF SYSTEM FOR APPLIANCES

(71) Applicant: WHIRLPOOL CORPORATION, Benton Harbor, MI (US)

(72) Inventors: Luiz Afranio Alves Ferreira, Santa Catarina (BR); Gean Ricardo Hay, Santa Catarina (BR); Edson Isaltino Bento, Santa Catarina (BR)

(73) Assignee: Whirlpool Corporation, Benton Harbor, MI (US)

( * ) Notice: Subject to any disclaimer, the term of this patent is extended or adjusted under 35 U.S.C. 154(b) by 20 days.

(21) Appl. No.: 15/075,308

(22) Filed: Mar. 21, 2016

(65) Prior Publication Data

US 2016/0270536 A1 Sep. 22, 2016

(30) Foreign Application Priority Data

Mar. 20, 2015 (BR) ..... 102015006334

(51) Int. Cl.
*A47F 5/08* (2006.01)
*A47B 96/06* (2006.01)
(Continued)

(52) U.S. Cl.
CPC ..... *A47B 96/068* (2013.01); *A47B 57/08* (2013.01); *A47B 96/021* (2013.01); *F24C 15/16* (2013.01);
(Continued)

(58) Field of Classification Search
CPC ..... A47B 96/068; A47B 96/021; A47B 57/08; A47B 96/027; A47B 57/06; F25D 25/02; F25D 25/04; F24C 15/16
(Continued)

(56) References Cited

U.S. PATENT DOCUMENTS 569,640 A * 10/1896 Hartzell ..... A47B 57/567 108/147.11
1,288,010 A * 12/1918 Isaac ..... A47B 57/42 108/147.17
(Continued)

FOREIGN PATENT DOCUMENTS

CN 1896665 A 1/2007
CN 203464596 U 3/2014
(Continued)

*Primary Examiner* — Joshua J Michener
*Assistant Examiner* — Devin Barnett
(74) *Attorney, Agent, or Firm* — Price Heneveld LLP

(57) ABSTRACT

An adjustable shelf system for a household appliance includes at least one shelf assembly having at least one support structure, wherein each support structure of the shelf assembly includes upper and lower coupling elements outwardly extending from the support structures. A track member is coupled to a sidewall of an internal compartment of the appliance. The track member includes an outer surface with at least one longitudinal channel disposed therein. The longitudinal channel further includes a plurality of spaced-apart receiving notches disposed along a vertical length the channel. The upper and lower coupling elements of the support structures are configured to be received in the longitudinal channels of the track members and nested within the receiving notches thereof.

10 Claims, 7 Drawing Sheets

(51) Int. Cl.

| | |
|---|---|
| ***A47B 96/02*** | (2006.01) |
| ***F25D 25/02*** | (2006.01) |
| ***F24C 15/16*** | (2006.01) |
| ***A47B 57/08*** | (2006.01) |
| *F25D 25/04* | (2006.01) |

(52) U.S. Cl.
CPC ..... *F25D 25/02* (2013.01); *A47B 96/027* (2013.01); *A47B 96/06* (2013.01); *F25D 25/04* (2013.01)

(58) Field of Classification Search
USPC ..... 108/147.11, 147.16, 147.17; 312/408, 312/410, 228.1; 211/153, 187
See application file for complete search history.

(56) References Cited

U.S. PATENT DOCUMENTS 1,920,452 A * 8/1933 Wagner ..... A47B 41/02 108/32
2,420,173 A * 5/1947 Hall ..... F25D 25/02 126/337 R
2,932,409 A * 4/1960 Wineman, Jr. ..... A47B 57/50 211/187
3,162,416 A * 12/1964 Amarillas ..... A47B 57/34 248/244
3,316,044 A * 4/1967 Carbary ..... A47B 57/06 108/106
3,469,870 A * 9/1969 Barkus ..... E04G 25/06 108/150
3,482,706 A * 12/1969 Stewart ..... A47B 57/42 211/87.01
3,579,710 A * 5/1971 Gartzke ..... A47B 57/26 16/93 R
3,991,537 A * 11/1976 Brown ..... E04F 19/026 248/188.8
4,158,998 A * 6/1979 Clement ..... A47B 57/16 108/147.15
5,197,705 A * 3/1993 Baskas ..... A47G 29/08 248/316.7
5,265,740 A * 11/1993 Hodsden ..... A47B 57/08 211/187
5,350,073 A * 9/1994 Thornley ..... A47B 57/22 108/107
5,390,811 A * 2/1995 Ogino ..... B65D 21/0223 206/445
5,478,145 A * 12/1995 Kamachi ..... F16B 12/12 108/107
5,884,434 A * 3/1999 Dedrich ..... E05B 85/12 296/146.7
5,934,486 A * 8/1999 Jarvis ..... A47B 81/04 211/126.12
6,273,281 B1 * 8/2001 Berglund ..... A47B 57/50 108/107
6,393,658 B1 * 5/2002 Chong ..... A47B 21/06 16/2.2
6,634,510 B2 * 10/2003 Larson ..... A47L 15/501 211/126.12
7,240,980 B2 * 7/2007 Koons ..... A47B 88/044 312/334.8
7,607,744 B2 * 10/2009 Casoli ..... F25D 25/02 211/153
7,971,943 B2 * 7/2011 Quella ..... A47B 57/00 108/107
8,419,143 B2 4/2013 Shin et al.
8,419,864 B2 * 4/2013 Haltmayer ..... A47L 15/4217 134/56 D
8,424,692 B2 * 4/2013 Ala ..... F25D 25/02 134/135
8,556,074 B2 * 10/2013 Turner ..... A61F 2/0095 206/339
8,950,595 B2 * 2/2015 Ammon ..... A47L 15/501 206/509
8,960,825 B2 * 2/2015 Kwon ..... F25D 23/04 108/106
9,302,811 B2 * 4/2016 Orgeldinger ..... B65D 21/083
2005/0103733 A1 * 5/2005 Saltzberg ..... A47B 57/50 211/187
2005/0162055 A1 * 7/2005 Bienick ..... A47B 57/48 312/408
2006/0097613 A1 * 5/2006 Lee ..... F25D 25/02 312/408
2007/0252498 A1 * 11/2007 Wing ..... F25D 25/02 312/408
2008/0309211 A1 * 12/2008 Wilson ..... F24C 15/162 312/410
2009/0261051 A1 * 10/2009 Dittus ..... H05K 7/1489 211/207
2010/0066227 A1 * 3/2010 Ramm ..... A47B 51/00 312/408
2013/0026321 A1 * 1/2013 Richardson ..... A47B 95/002 248/235
2013/0081421 A1 * 4/2013 Kwon ..... F25D 23/04 62/440
2013/0088136 A1 * 4/2013 Bassi ..... F25D 25/02 312/408
2015/0102718 A1 * 4/2015 Liu ..... F25D 25/02 312/405
2015/0276304 A1 * 10/2015 Choo ..... F25D 25/024 312/408
2015/0300726 A1 * 10/2015 Yi ..... F25D 23/062 312/317.3
2015/0300728 A1 * 10/2015 Kim ..... F25D 25/02 312/408
2016/0047594 A1 * 2/2016 Choo ..... F25D 25/02 312/404
2016/0146532 A1 * 5/2016 Choo ..... A47B 88/047 312/408

FOREIGN PATENT DOCUMENTS

EP 1443292 A2 4/2004
WO WO 2013082845 A1 * 6/2013 ..... F25D 25/02

* cited by examiner

ADJUSTABLE SHELF SYSTEM FOR APPLIANCES

CROSS REFERENCE TO RELATED APPLICATION

This present application claims priority to BR 10 2015 006334.2, filed Mar. 20, 2015, the entire contents of which are incorporated by reference.

FIELD

The present concept relates to an adjustable shelf system for electric appliances, such as appliances having internal compartments like refrigerators, ovens and the like. The shelf system includes track members that allow easy and safe adjustment of shelves between different height levels within the internal compartments of appliances, such that users can customize the internal compartments of an appliance as needed in a simple, easy and safe manner.

BACKGROUND

Many appliances, such as refrigerators, have internal compartment regions for the storage of foods, and these compartment regions are generally divided horizontally by shelves aimed at optimizing the use of the available storage space.

A conventional form of coupling shelves within a refrigerator compartment involves the use of horizontal rails secured to or molded into the side and rear walls of the refrigerator compartment which are then used to support shelves at side perimeter edges of the shelves. However, such support configurations generally require the complete removal of an internal cavity shelf in order for a user to change or adjust the horizontal level or location of the shelf within the refrigerator or freezer compartment. Further, these configurations require a user to remove all items stored on the shelves before the adjustment procedure to avoid accidents and ensure safe adjustment.

An attempt to solve this issue was presented in CN203464596, EP1443292 and U.S. Pat. No. 8,419,143 which, each with its own characteristics, describe shelves that can be slid up and down by two rails positioned in the posterior region of the refrigerator cabinet, so that the front region thereof remains in balance. This configuration, however, requires that the shelves be constructed with more complex and robust structures, since they require additional elements, such as locking parts and reinforced side frames, to act as "French hand" which can bear the weight of stored items supported by the shelves. Moreover, such configurations work with only one or, at most, two points of contact with the rails in addition to having various constituent components and are therefore complex and costly to manufacture.

Examples from the CN1896665 reference are illustrated in FIGS. 1A and 1B, wherein a solution for a vertical sliding shelf 1 in the internal cavity 2 of a refrigerator unit comprises, in its internal side walls, surfaces 3 provided with meandering rails or paths 4 and footholds in front and rear regions, such that the displacement of the shelf 1 is made by moving the shelf 1 in a "zigzag" motion along the rails 4. The configuration shown in FIG. 1A requires that the constituent components are less robust due to the distribution of the loads acting on the shelves 1. However, with reference to FIG. 1B, the repositioning of the shelf 1 requires a sharp horizontal movement, which requires a front portion of the shelves project outwardly towards the front of the refrigerator cabinet 2, and thus can cause for displacement of any stored item positioned thereon during shelf adjustment. Another drawback of this solution is the fact that the rails 4 are shaped in a same plate or surface 3. Thus, for each machine model having varied internal capacities, specific parts are required to suit the depth of the internal cavity 2. This requirement compromises the practicality of production lines involving several product platforms with different storage capacities.

Therefore, the present state of the art lacks practical, versatile and safe solutions to allow vertical adjustment of the shelves inside cold rooms, cooking rooms or other internal compartments of appliances in general.

Therefore, the present concept addresses the technical issues and complexities of the prior art with regards to vertical adjustment of shelves within internal compartments of appliances.

As a result, an objective of the present concept is to provide an adjustable shelf system for household appliances with simple and economical operation.

Further, an objective of the present concept is to provide a versatile system that can be easily adapted to different designs and capabilities in an appliance with which the system is to be utilized. Comprising separate front and rear track members within an internal compartment, the present concept allows for shelves that can be installed at different distances. That is, the shelf system of the present concept provides an adjustable feature for accommodating different depths of shelves.

Another objective of the present concept is to provide a shelf system that allows vertical adjustment of internal shelves of refrigerator cabinets or cooking cavities without having to remove all of the items supported on the shelves or remove the shelves themselves from the appliance.

Another objective of the present concept is to provide a shelf support system including four contact points in order to promote a better distribution of loads, as well as greater stability and security in use.

SUMMARY

The above objectives of the present concept are achieved through an adjustable shelf system for appliances, wherein the appliances include a chassis having at least one internal cavity, cabinet or compartment in which the shelves are arranged for supporting various items.

According to a preferred embodiment of the present concept, the shelf system includes at least one track member cooperating with the internal compartment of the appliance and the shelves. The track member includes at least one perimeter or outer surface with at least one winding centrally disposed longitudinal channel for stabilization/locking the shelves therein. Supporting structures support the shelves, wherein each supporting structure includes at least two cooperating coupling elements configured to engage at least one longitudinal channel of the track member, and further wherein each track member is independently supported on sidewalls of the internal compartment or casing of the appliance.

Preferably, each track member cooperates with the internal compartment of the appliance through interference couplings disposed therebetween. Further, the perimeter or outer surfaces of each track member may be configured to receive interference couplings that outwardly extend from the surfaces of the internal compartment.

The system of the present concept may further comprise at least one alternate track member configuration cooperating with the internal compartment and the shelves, wherein the alternate track member includes a surface provided with at least one centrally disposed longitudinal channel.

Also, according to a preferred embodiment of the present concept, the central longitudinal channels of the track members comprise female-like members that cooperate with male-type coupling elements that outwardly extend from the supporting structures of the shelves. The supporting structures are contemplated to be integral features of the shelves formed by a molding procedure, or joined thereto by welding, interference coupling or by fasteners.

Optionally the supporting structures may cooperate with the side edges of the shelves in positions corresponding to the installation positions of the rails on the internal compartment.

Also, it is contemplated that the internal compartment comprises recesses for coupling the track members thereto. It is also contemplated that these recesses further include recesses or fastening slots cooperating with locking elements disposed on rear faces of the track members.

It should be noted that cooperation between the internal compartment and the track members is aided by the expansion process of the polyurethane foam used to shape the product's enclosure.

These and other features, advantages, and objects of the present concept will be further understood and appreciated by those skilled in the art upon studying the following specification, claims, and appended drawings.

DETAILED DESCRIPTION OF EMBODIMENTS

Figure 1A:
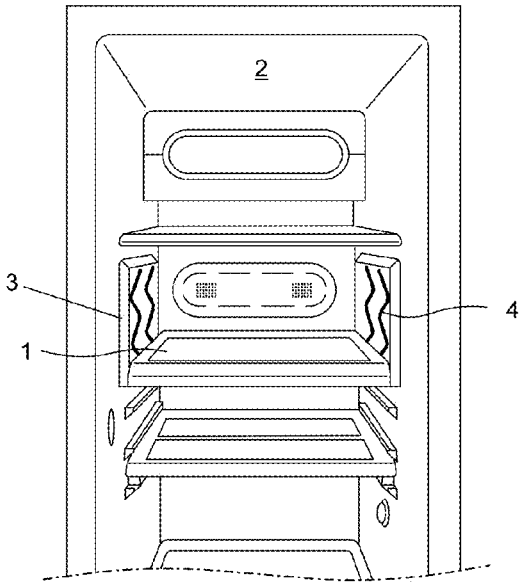
PRIOR ART FIG. 1A
FIG. 1A is a fragmentary front perspective view of a sliding shelf system of the prior art.
Figure 1B:
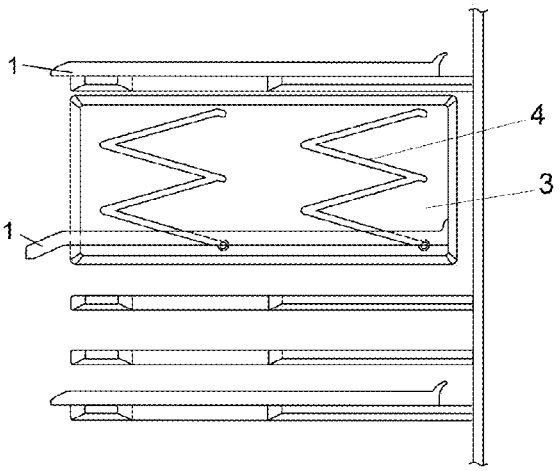
PRIOR ART FIG. 1B
FIG. 1B is a fragmentary side elevational view of the sliding shelf system of FIG. 1A.
Figure 2A:
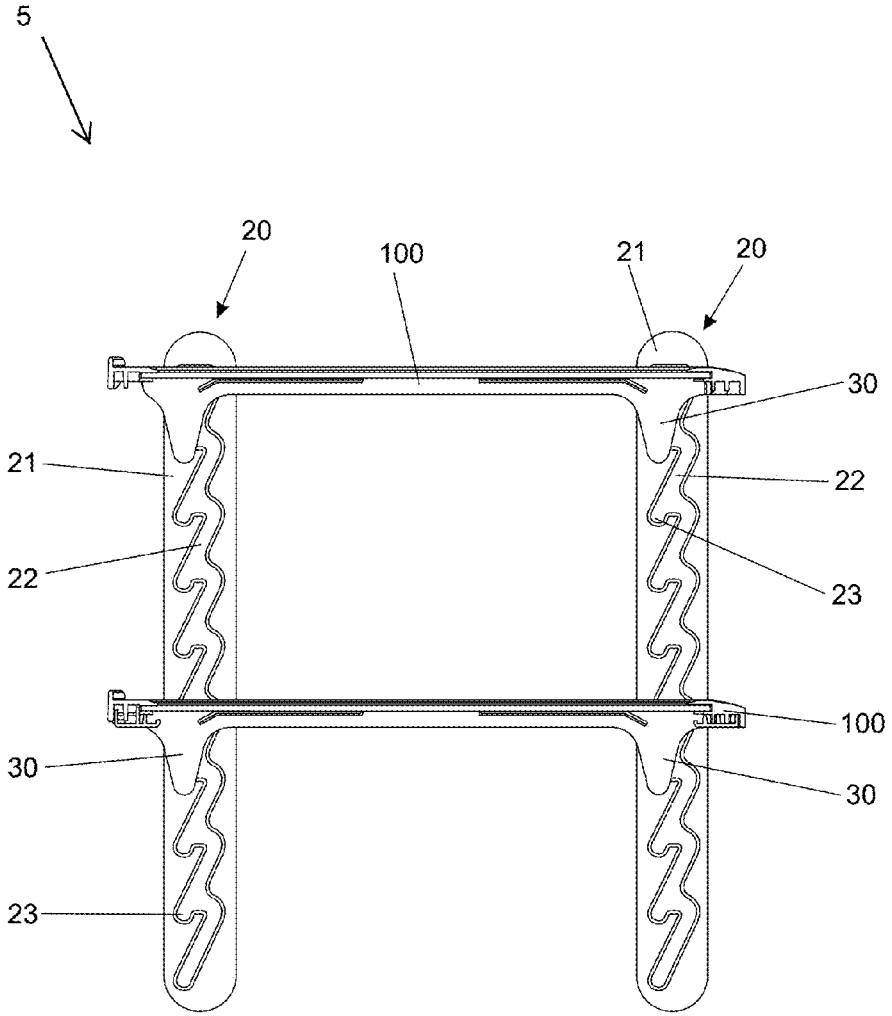
FIG. 2A is a side elevational view of an adjustable shelf system for home appliances according to one embodiment of the present concept, wherein two spaced-apart shelves are shown supported on identical front and rear track members.

For purposes of description herein the terms "upper," "lower," "right," "left," "rear," "front," "vertical," "horizontal," and derivatives thereof shall relate to the device as oriented in FIG. 2A. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present concept relates to an adjustable shelf system 5 (FIG. 2A) for household appliances. The shelf system 5 of the present concept is particularly suited for use with appliances having a cabinet structure that defines an internal compartment 40 (FIG. 4) in which the shelves 100 (FIG. 2A) are configured to be arranged to support various items in use.

With specific reference to the embodiment of FIG. 2A, the shelf system 5 includes two track members 20 which are identical in configuration and positioned in FIG. 2A to define front and rear track members relative to one another. Each track member 20 includes a substantially planar outer surface 21 with a centrally disposed sinuous longitudinal channel 22 having a plurality of receiving notches 23 disposed therealong. The receiving notches 23 are configured to receive coupling elements of the shelves 100 to stabilize and lock the shelves 100 in place at desired heights along the channel 22, as further described below.

Figure 2B:
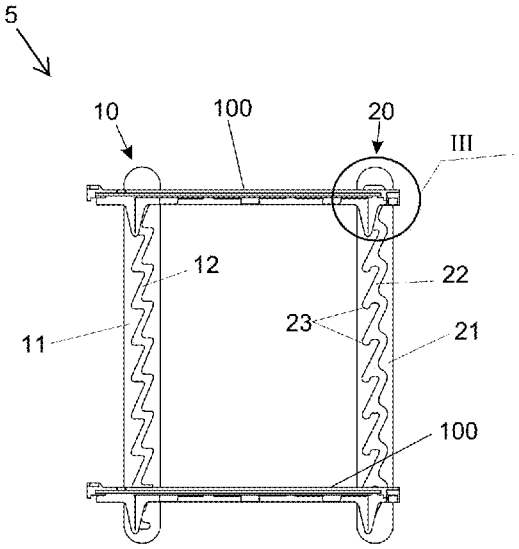
FIG. 2B is a side elevational view of an adjustable shelf system for home appliances according to another embodiment of the present concept, wherein two spaced-apart shelves are shown supported on front and rear track members having different configurations relative to one another.
Figure 3:
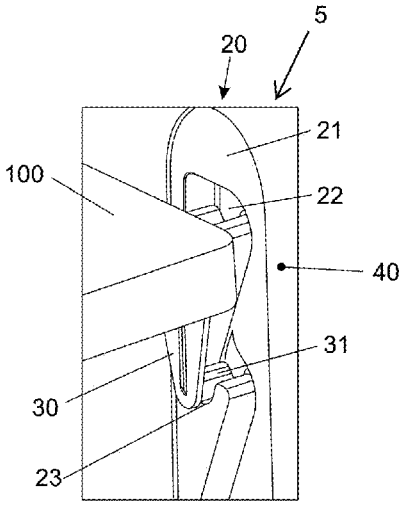
FIG. 3 is a fragmentary perspective enlarged view of the coupling of the shelf and track member of FIG. 2B taken at location III.
Figure 4:
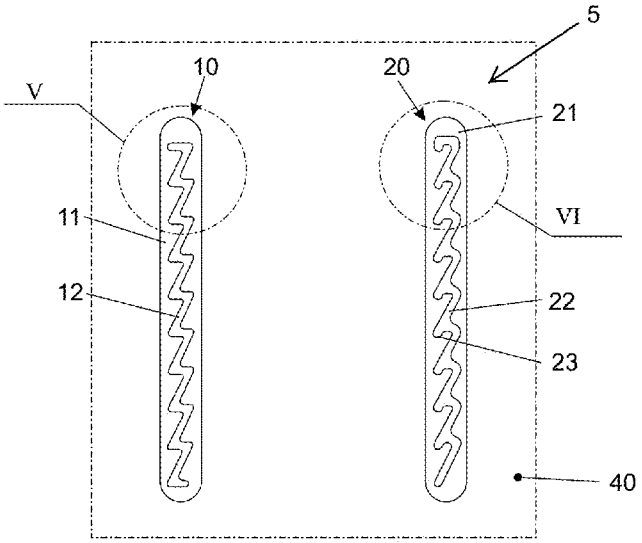
FIG. 4 is a side elevational view of the front and rear track members according to the embodiment illustrated in FIG. 2B as mounted to an internal compartment of a household appliance.
Figure 5:
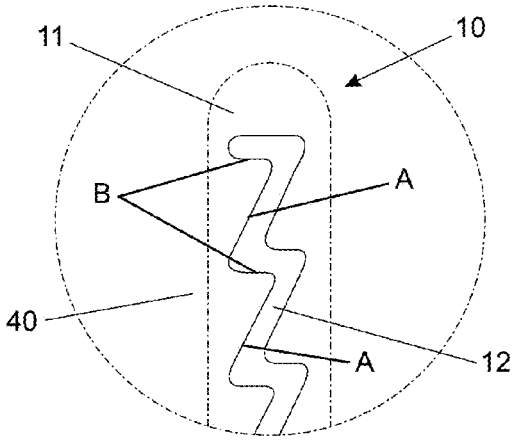
FIG. 5 is a fragmentary side elevational enlarged view of the rear track member of FIG. 4 taken at location V.
Figure 6:
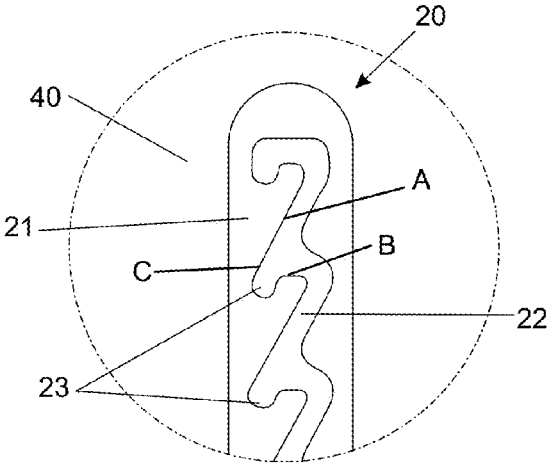
FIG. 6 is a fragmentary side elevational enlarged view of the front track member of FIG. 4 taken at location VI.

Another embodiment of the present concept is shown in FIGS. 2B and 4, in which a rear track member 10 includes a substantially planar outer surface 11 having a central longitudinal channel 12 disposed in a series of interconnected Z formations. Thus, the channel 12 has a winding configuration defined by inclined riser portions A which alternate with horizontal step portions B along a length of the channel 12. The channel 12 defines a female recess for receiving coupling pins or male coupling elements 31 (FIG. 3) of the shelves 100 at a desired vertical location along the channel 12 as best shown in FIG. 5. The coupling pins 31 are configured to be supported on the horizontal step portions B of channel 12. As further shown in FIGS. 2B and 4, track member 20 defines a front track member in relation to rear track member 10. Front track member 20 includes a configuration consistent with the configuration noted above for track members 20 described with reference to FIG. 2A. As such, front track member 20 includes a flat outer surface 21 with a winding centrally disposed longitudinal channel 22, as further shown in FIG. 6. Much like channel 22 in FIGS. 2A and 6, channel 22 in FIG. 2B includes receiving notches 23 disposed vertically along the length of the channel 22 in a spaced-apart relationship to one another. The channel 22 includes inclined riser portions A and horizontal step portions B, wherein the receiving notches are disposed at posterior ends C of the step portions B.

Referring now to FIG. 3, the shelf system 5 also comprises support structures 30 which are preferably disposed along the lateral edges of the shelf 100. The support structures 30 include one or more male-type coupling elements 31, which outwardly extend from the support structures 30 and are configured to be received in the longitudinal channels 12, 22 of the track members 10, 20, respectively. As further shown in FIG. 3, a lower coupling element is nested within receiving notch 23.

Figure 10:
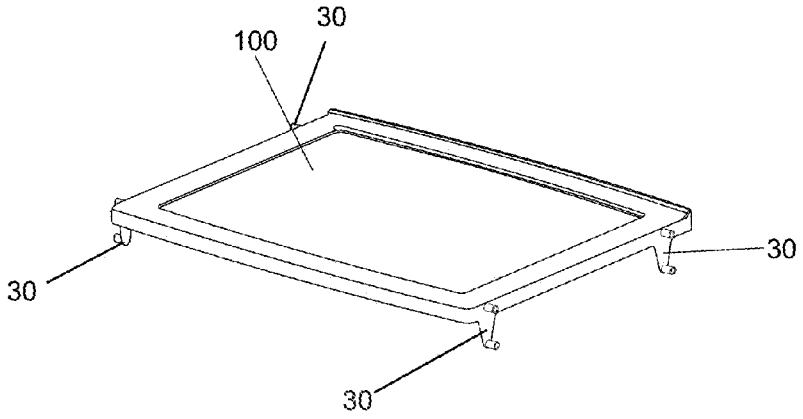
FIG. 10 is a perspective view of a shelf according to one embodiment which is configured for use with the system of the present concept.
Figure 11:
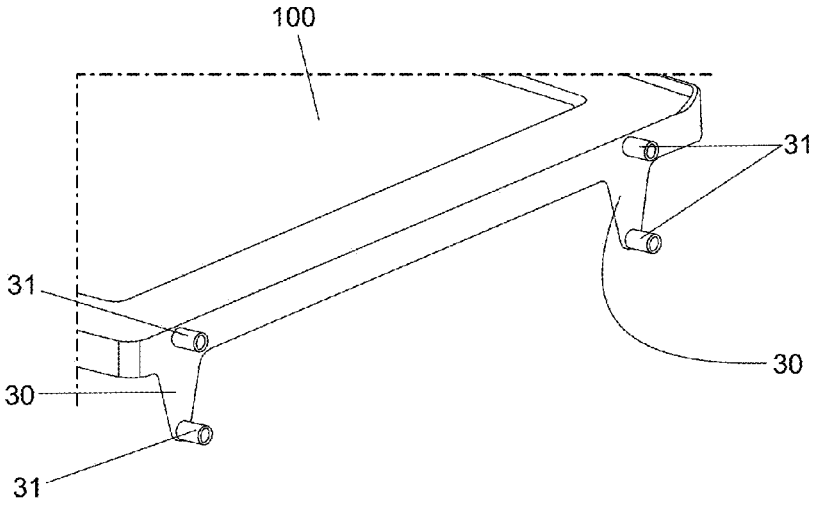
FIG. 11 is a fragmentary perspective view of a side portion of the shelf of FIG. 10 showing, in greater detail, support pins disposed at each point of contact between the shelf and the track member.

With reference to FIGS. 10 and 11, more detail is shown with regards to the support structures 30 of the shelves 100. The support structures 30 can be integrally formed or molded as a part of the shelves 100 during the workpiece production process. Alternatively, the support structures 30 can be fixed to the shelves 100 by means of welding, coupling interference or by fasteners without departing from the spirit of the present concept.

According to another embodiment of the present concept, the shelves 100 are provided with, on each lateral edge or side portion, two support structures 30, such that each shelf 100 is contemplated to include a total of four support structures 30. As shown in FIGS. 10 and 11, the support structures 30 are arranged in specific locations (the four outer corners of the shelves 100) to cooperate with various arrangements of track members, such as differing track members 10 and 20 shown in FIG. 2B, or identical track members 20 shown in FIG. 2A. In FIGS. 2A and 2B, the configuration of the track members 10, 20 provide for front and rear track members 20, 10 disposed on the sidewalls of the internal compartment 40. In this regard, the construction of the shelves 100 and the track members 10, 20 allows for a user to adjust the shelf system 5 for shelves 100 of various sizes for use in electrical appliances with different internal capacities, since the spacing between the posterior and anterior track members can be changed to meet the diverse needs of each user and each appliance. In this way, the shelf system 5 does not require the production of track members with specific dimensions and customized distances for each model of appliance, thereby making the present system extremely versatile as compared to those systems known in the current state of the art.

Figure 7:
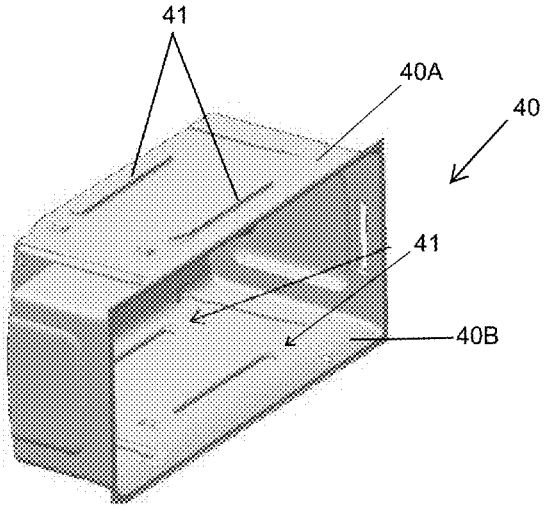
FIG. 7 is a perspective view of an internal compartment of a household appliance configured to receive an adjustable shelf system of the present concept.
Figure 8:
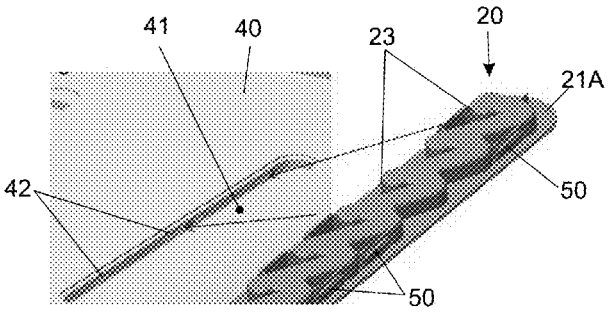
FIG. 8 is a perspective view of various coupling elements used to couple a track member to an internal compartment of an appliance.
Figure 9:
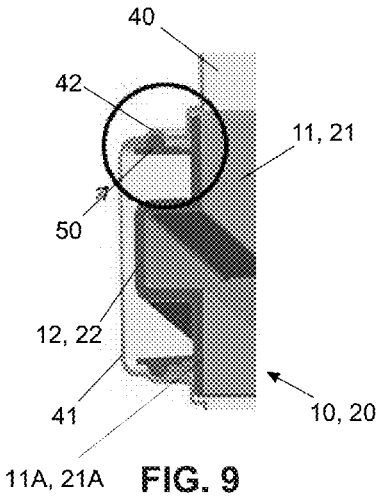
FIG. 9 is a cross-sectional perspective view of the coupling elements of FIG. 8 cooperating to support a track member on a surface of an internal compartment.
Figure 12A:
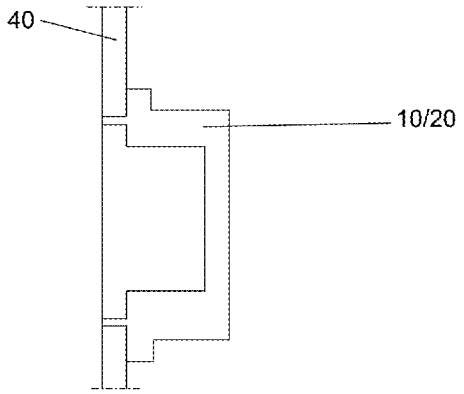
FIGS. 12A-12C are cross-sectional views of alternative embodiments for coupling track members to an internal compartment of an appliance.
Figure 12B:
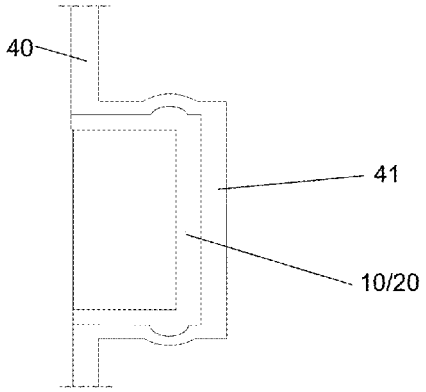
Figure 12C:
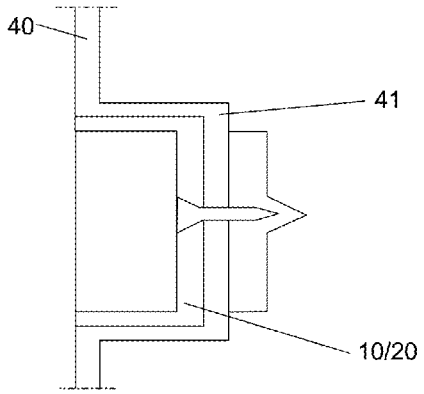

With reference to FIGS. 7, 8 and 9, it can be seen that the internal compartment 40 of the appliance is formed with two pairs of receiving recesses 41 disposed on both sidewalls 40A and 40B thereof. Thus, it is contemplated that the internal compartment 40 will have four track members disposed therein; two front track members and two rear track members on each sidewall 40A, 40B of the internal compartment 40. The receiving recesses 41 each include coupling features for coupling the track members 10 or 20 thereto, and these coupling features are best shown in FIGS. 8 and 9 as engagement slots 42 used to couple with locking elements 50 extending outwardly from the rear faces 11A or 21A of the track members 10 or 20. Thus, as shown in FIGS. 8 and 9, the engagement slots 42 of the receiving recesses 41 constitute female type coupling means which receive the male-type locking elements 50 disposed on the rear faces 11A or 21A of the track members 10 or 20 which are contemplated to be flexibly resilient locking members 50 having detent features. However, one skilled in the art will recognize that the receiving recesses 41 can alternatively comprise male-type features used to cooperate with female-type locking elements. Further, other methods of coupling the track members 10, 20 to the sidewalls of the internal compartment 40 may vary, as best illustrated in the exemplary coupling configurations of FIGS. 12A-12C. The coupling arrangement described and illustrated in FIGS. 8 and 9 is considered to be more advantageous for the purposes of the present concept when taking into account construction methods, fixing forms, quality, durability and cost, among other factors involving the production of such equipment.

It is also worth noting that after the coupling of track members 10, 20 to the sidewalls of the internal compartment 40, the attachment between these parts is enhanced by the expansion process of a polyurethane foam insulating material that can be used to insulate the internal compartment 40. The foam expansion rigidifies the structure of the internal compartment 40, which provides enhanced connections between the receiving recesses 41 and the track members 10, 20, thereby ensuring that the track members 10, 20 remain securely in place within the internal compartment 40.

As further shown in FIGS. 10 and 11, each shelf 100 includes four points of contact with the track members of an internal compartment. As specifically shown in FIG. 10, the front and rear regions of the side portions of the shelf 100 each include support structures 30. This configuration of front and rear support structures 30 on both sides of the shelf 100 promotes better distribution of loads to be supported by the shelves 100. Thus, this configuration helps to minimize the risk of accidents, overload and disengagement of the shelves 100 from the track members. Moreover, each of these four support structures 30 has two outwardly extending pins or coupling elements 31, which define male-type engagement features configured to be received in the central longitudinal channels 12, 22 of the track members 10, 20, respectively. The coupling elements 31 are shown in pairs of upper pins and lower pins per support structure 30, wherein the upper pins are intended to support the primary loading of shelves 100 on the track members 10, 20, while the lower pins are intended to stabilize a shelf 100 during secondary loading. The upper and lower pins of the coupling elements 31 are configured to nest in adjacent receiving notches 23 that are vertically spaced-apart along a channel, such as channel 22 found in track member 20. Having upper and lower pins 31 at each supporting structure 30, each shelf may include eight points of contact with the track members to provide a secure connection therebetween.

It is worth remembering also that in accordance with a second preferred embodiment of the present concept shown in FIG. 4, the longitudinal central channel 12 of the rear rail 10 is designed to allow a smoother movement of the shelf 100 during vertical adjustment, with the front rail 20 provided with receiving notches 23 used to stabilize and lock the shelves 100 in place.

Thus, the present concept provides the following advantages over known shelf adjustment systems. (1) The present shelf system 5 has individual tracks that allow greater flexibility and versatility to suit different depths of shelves for various models and internal configurations of different appliances. (2) The present shelf system 5 has a total of eight points of contact (pins 31) with the internal compartment 40, which promotes better distribution of loads supported by the shelves and eliminates overloading of the tracks found in the prior art which required more robust and expensive parts for added security. (3) The present shelf system 5 includes locking elements that can be located in front of a user, or on anterior and posterior portions of the shelves, thereby providing greater versatility for a vertical adjustment procedure. (4) The present shelf system 5 includes connections between track members and receiving recesses that are reinforced by the expansion of polyurethane foam used to insulate outer walls of an internal cabinet. (5) The present shelf system 5 provides a reduction in the number of constituent parts, both for manufacturing and for system assembly, which is ultimately realized in the form of reduced costs of manufacture and assembly.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An adjustable shelf system for a household appliance having an internal compartment, comprising:

at least one shelf assembly having at least one support structure, wherein each support structure includes upper and lower coupling elements outwardly extending therefrom;

a track member coupled to a sidewall of the internal compartment, the track member having an outer surface with at least one longitudinal channel disposed therein, wherein the longitudinal channel includes alternating inclined riser portions and horizontal step portions, wherein the inclined riser portions each include first and second ends, and further wherein the horizontal step portions each include first and second ends thereof, wherein a corresponding end of each inclined riser portion is continuous with a corresponding end of a respective horizontal step portion to form the at least one longitudinal channel, and further wherein a plurality of receiving notches are disposed along a length of the at least one longitudinal channel;

wherein the upper and lower coupling elements of the support structure are received in the longitudinal channel of the track member and nested within the receiving notches thereof; wherein a receiving recess is formed within the sidewall, wherein the track member is received within the receiving recess; wherein the receiving recess of the internal compartment includes one or more receiving slots;

wherein the track member further includes locking elements outwardly extending from a rear face of the track member;

wherein the locking elements of the track member are elongated members having detent members extending perpendicularly therefrom, wherein the detent members are received in the respective receiving slots of the receiving recesses of the internal compartment.

2. The adjustable shelf system of claim 1, wherein the receiving notches are disposed at posterior ends of the step portions.

3. The adjustable shelf system of claim 1, wherein the upper and lower coupling elements comprise upper and lower pins.

4. An adjustable shelf system for an internal compartment of an appliance, the shelf system comprising:

front and rear track members disposed in front and rear receiving recesses defined within a first sidewall of the internal compartment and front and rear track members disposed in front and rear receiving recesses defined within a second sidewall of the internal compartment, wherein the front and rear receiving recesses of the first and second sidewalls each define first and second vertically disposed side member inner walls having engagement slots formed directly in the first and second side member inner walls, and further wherein each track member of the first and second sidewalls includes a longitudinal channel recessed from an outer surface thereof;

at least one shelf assembly having first and second side portions, the first and second side portions each having front and rear support structures disposed thereon, each support structure having at least one coupling element extending outwardly therefrom; and wherein the coupling elements of the front and rear support structures of the first side portion of the shelf assembly are received in the longitudinal channels of the front and rear track members disposed on the first sidewall of the internal compartment, respectively, and further wherein the coupling elements of the front and rear support structures of the second side portion of the shelf assembly are received in the longitudinal channels of the front and rear track members disposed on the second sidewall of the internal compartment, respectively; wherein each of the track members further include locking elements outwardly extending from a rear face of each track member; wherein the locking elements of the track members are configured to align with and be received in the respective engagement slots disposed within the first and second side member inner walls of the receiving recesses of the internal compartment.

5. The adjustable shelf system of claim 4, wherein the at least one coupling element of the support structures comprises upper and lower pins.

6. The adjustable shelf system of claim 4, wherein the at least one coupling element of the support structures comprises upper and lower pins.

7. The adjustable shelf system of claim 6, wherein the longitudinal channels of the front track members each include a plurality of receiving notches vertically disposed in a spaced-apart relationship along a length thereof.

8. The adjustable shelf system of claim 7, wherein the upper and lower pins of the front support structures are received in adjacent receiving notches within a respective longitudinal channel of the front track members.

9. The adjustable shelf system of claim 8, wherein the longitudinal channels of the rear track members each include a plurality of receiving notches vertically disposed in a spaced-apart relationship along a length thereof.

10. The adjustable shelf system of claim 7, wherein the upper and lower pins of the rear support structures are received in adjacent receiving notches within the longitudinal channels of the rear track members respectively.

* * * * *